US008356614B2

(12) United States Patent
Forrester

(10) Patent No.: US 8,356,614 B2
(45) Date of Patent: Jan. 22, 2013

(54) SELF DEFENSE SPRAY WALKING STICK AND METHODOLOGY OF OPERATING SAME

(76) Inventor: John Wayne Forrester, Reno, NV (US)

( * ) Notice: Subject to any disclaimer, the term of this patent is extended or adjusted under 35 U.S.C. 154(b) by 134 days.

(21) Appl. No.: 12/959,364

(22) Filed: Dec. 2, 2010

(65) Prior Publication Data

US 2011/0132419 A1 Jun. 9, 2011

Related U.S. Application Data

(60) Provisional application No. 61/283,320, filed on Dec. 3, 2009.

(51) Int. Cl.
*A45B 3/00* (2006.01)
*A63C 11/22* (2006.01)

(52) U.S. Cl. ..... 135/66; 135/83; 222/174; 222/192; 222/402.2; 280/816; 280/821

(58) Field of Classification Search ..... 135/65–66, 135/72, 83; 280/816, 819–821; 222/160, 222/174–175, 389, 402.2, 402.12, 402.15, 222/192; 116/142 FR, 137 R; 239/532, 239/579

See application file for complete search history.

(56) References Cited

U.S. PATENT DOCUMENTS

| | | | | | |
|---|---|---|---|---|---|
| 2,385,091 | A * | 9/1945 | Lukowitz | 472/52 |
| 2,438,014 | A * | 3/1948 | Lukowitz | 135/66 |
| 3,038,483 | A * | 6/1962 | Altsheler | 135/16 |
| 3,593,926 | A * | 7/1971 | Kozub | 239/579 |
| 4,967,684 | A * | 11/1990 | Vidovic et al. | 116/142 FP |
| 5,405,134 | A * | 4/1995 | Wolfram | 463/47.4 |
| 5,429,389 | A * | 7/1995 | Shandell | 280/821 |
| 5,709,635 | A * | 1/1998 | Denison | 482/108 |
| 5,901,723 | A * | 5/1999 | Ames | 135/66 |
| 6,957,750 | B1 * | 10/2005 | Trudell | 222/174 |
| 7,717,300 | B1 * | 5/2010 | Yarrusso, Jr. | 222/174 |

* cited by examiner

*Primary Examiner* — Winnie Yip
(74) *Attorney, Agent, or Firm* — John D. Long, Esq

(57) ABSTRACT

One possible embodiment could be a self-defense walking stick and a process of operating same, the stick comprising of a shaft having two ends, a first end and a second end; a grip having a body with a top end and a bottom end, the top end having a top aperture connected to a top open-ended channel, the bottom end having a bottom aperture connected to a bottom open-ended channel that receives the first end of the shaft; an aerosol irritant dispensing canister comprising of a pressurized cylinder of irritant connected to activating and dispensing mechanisms, wherein a portion of the canister is retained within the top open-ended channel to expose the activating and dispensing mechanisms above the top end; and a tip connecting to the second end to interact with a surface of a ground being traversed by the operator using the stick.

14 Claims, 6 Drawing Sheets

SELF DEFENSE SPRAY WALKING STICK AND METHODOLOGY OF OPERATING SAME

CROSS-REFERENCES TO RELATED APPLICATIONS

This application claims the benefit under 35 U.S.C. §119 (e) of U.S. Provisional Patent Application No. 61/283,320 filed on Dec. 3, 2009, the contents of which are relied upon and incorporated by reference.

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to walking sticks as used in hiking. More specifically, the present invention may relate to those walking sticks that may be further capable of providing an irritant emission.

BACKGROUND

Popular with walkers, hikers, and others that enjoy great outdoor activities is the use of walking aid devices such as walking or hiking sticks or poles. These walking sticks generally comprise of shaft with two ends, one end locating a grip by which the stick is grasped by the operator and another end supporting a walking tip against the ground. Generally, a pair of such devices are used by hikers and alike to help steady their gait through passage among uneven terrain; shift some of weight of any load they are carrying (e.g., backpack or supplies) to their arms/walking sticks; reduce stress on feet, ankles, knees, hips and back; or to otherwise further aid the hiker's propulsion during the walk or hike.

These sticks have also been used in providing self-defense or protection for their operator. Generally, this type of self-defense usage occurs in non-urban wildlife areas, such forests and alike, where the hiker can come into contact with much larger (and potentially more dangerous) wildlife. This contact becomes more frequent as human encroachment increases in normally isolated wildlife areas. There have been incidents where chance human encounters with bear, cougar (i.e., mountain lion), and alike have ended badly for hikers (being mauled or killed by the animal) as hikers have accidently strayed into such animal proximity that was the subject of the presence of the animals' young or food source. Further, such former isolated wildlife areas that are seeing an increase in human visitation can become the scenes of illegal activities, where criminal predation upon walkers, hikers and other outdoor persons may occur with increasing frequency.

To address such matters, some walking sticks have been constructed to augment their inherent physical defensive capabilities in hitting or poking to fending off attacks. These augmentations may include operator-controlled, aerosol emissions (e.g., sprays, foams, streams, or combinations thereof) containing ingredients that may act as irritants to humans and other animals. Such irritants may include oleo capsicum ("pepper spray"); phenacyl chloride (CN); 2-chlorobenzalmalononitrile (CS or "tear gas") and the like, where the effective contact of such irritants with the skin, tear ducts, eyes, mouth, nose of the attacker may produce a very unpleasant reaction/sensation to the attacker that ranges from driving off the attacker to actually causing the incapacitation of the attacker.

Walking sticks that have integrated aerosol irritant dispensing systems into their construction may orient their irritant discharge through stick's walking tip upon activating a mechanical trigger that is part of the body of the stick. This type of construction may be seen as complicated in construction and cumbersome in use where seconds, moments, may count (e.g., a charging bear.) Such walking sticks generally need to be moved from a substantially vertical orientation to a more horizontal position to properly aim the dispensing walking tip at the offending/threatening entity. This pivoting stick movement may first require the operator to shift its stance to redistribute any supported weight off of the walking stick. Depending upon the stick's grip-type (e.g., a vertical vs. horizontal orientation) and operator's hand position upon the grip, the motion may further require the operator to shift its hand position as well (also increasing reaction time to the threat) to activate trigger (and deactivate any safety) mechanisms.

What is needed therefore is a self-defense walking stick, which generally utilizes an aerosol irritant discharge system that substantially allows an operator to activate the system with a minimal repositioning of walking stick and a minimal repositioning of the operator's hand upon on the walking stick to reduce the time necessary to the bring the device to bear upon its target and to issue the aerosol irritant emission or discharge at the target.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to economically and easily combine and integrate a commercially-available, hand-held, hand-operated, self-contained aerosol irritant dispensing canister with a walking stick;

to provide a self-defense walking stick that integrates an aerosol irritant dispensing canister to allow activation of the canister without moving the stick from a vertical walking position into a horizontal dispersion orientation;

the ability to activate an aerosol irritant dispensing canister of a self-defense walking stick without the repositioning the operator's hand upon the grip of the walking stick;

to provide a self-defense walking stick wherein the shaft, grip, and aerosol irritant dispensing canister are placed in a common longitudinal axis for ease of aiming and operating the canister;

to provide a self-defense walking stick wherein the activating and dispensing portions of aerosol irritant dispensing canister protrudes above the top of the grip of the walking stick for ease of operator access and operation;

the ability to easily and quickly replace a spent aerosol irritant dispensing canister of a self-defense walking stick with a fresh canister;

to provide a walking stick wherein the activating and dispensing portion of aerosol irritant dispensing canister protrudes above the top of the grip for the ease of replacing a spent canister; and to provide a walking stick wherein the activating and dispensing portion of aerosol irritant dispensing canister protrudes above the top of the grip for the ease of securing the canister to the grip.

These and other advantages may be realized by reference to the remaining portions of the specification, claims, and abstract.

Brief Description of One Embodiment of the Present Invention

One possible embodiment could be a self-defense walking stick comprising of a shaft, the shaft having two ends, a first end and a second end; a grip, the grip having a body with a top end and a bottom end, the top end having a top aperture connected to a top open-ended channel, the bottom end having a bottom aperture connected to a bottom open-ended channel that receives the first end of the shaft; an aerosol irritant dispensing canister wherein a portion of the canister is retained within the top open-ended channel to expose a remaining portion above the top end; and a tip, the tip connecting to the second end to interact with a surface of a ground being traversed by the operator with the stick.

Another possible embodiment could be a process of operating a walking stick comprising of the following steps, but not necessarily in the order shown, providing an walking stick having at least a shaft, a grip, and a hand-held, hand-operated, self-contained aerosol irritant dispensing canister, the grip being located on one end of the shaft, the grip further positioning the canister so that the canister's activating and dispensing mechanisms are exposed and located above an end of the grip that is not connected to the shaft, the grip, canister, and shaft sharing a common longitudinal axis; grasping the grip with a hand of an operator to allow the operator to walk with the stick; moving the hand without repositioning the hand on the grip to point the dispensing mechanism in the direction of a threat while maintaining the stick in a vertical orientation; and operating the activation mechanism to project an irritant spray towards the threat.

Another possible embodiment could be a self-defense walking stick comprising of a shaft having two ends, a first end and a second end; a grip having a body with a top end and a bottom end, the top end having a top opened-ended channel, the bottom end having an bottom open-ended channel that receives the first end of the shaft; a hand-held, hand-operated, self-contained aerosol irritant dispensing canister, the canister having a pressurized cylinder containing at least one irritant, the cylinder connected to activating and dispensing mechanisms, a portion of the canister being removably retained within the top open-ended channel to leave the activating and dispensing mechanisms being exposed above the top end of the grip; a tip connecting to the second end that interacts with a surface of a ground being traversed by the operator with the stick.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
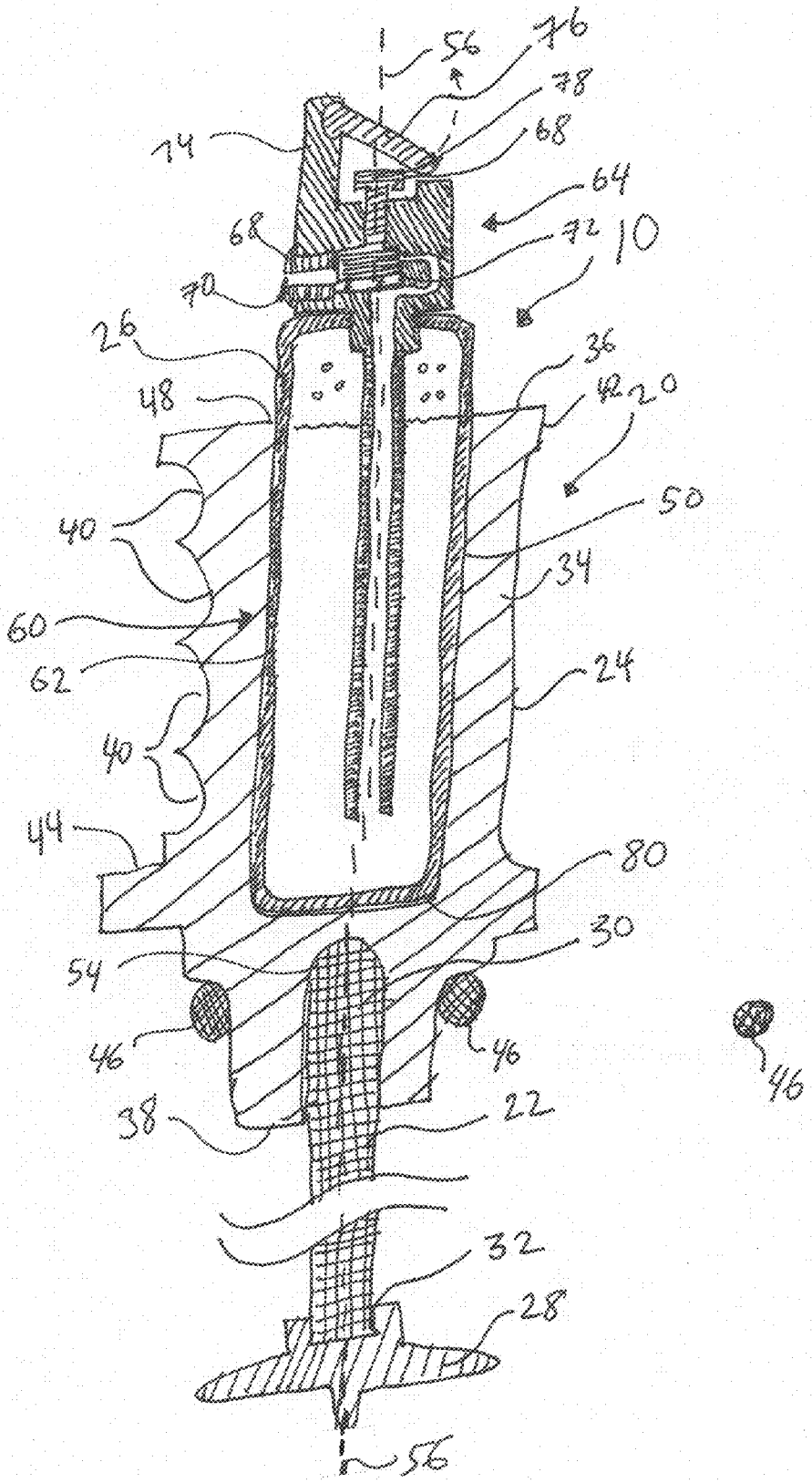
FIG. 1 is substantially a cutaway elevation view of one embodiment of the present invention.

The present invention 10 comprises a self-defense walking stick 20 and methodology or process of operating same 100. As substantially shown in FIG. 1, the walking stick 20 could comprise of a shaft 22, a grip 24, a hand-held, hand-operated, self-contained irritant spray canister 26, and tip 28. The shaft 22 could be a cylindrical length of carbon fiber, fiberglass, plastic, or other suitable material having two ends, a first end 30 and a second end 32. The first end 30 could support the grip 24 while the second end 32 could support a tip 28. In at least one embodiment, the shaft 22 could be made of nestling segments with appropriate locking devices to make the shaft 22 telescopic and adjustable in length to adapt to various operators having different heights and hence shaft length requirements.

The tip 28 could come in a wide variety of shapes, sizes, and compositions to adapt to a wide variety of ground surfaces encountered in hiking. The tip 28 could be reversibly attached to second end 32 of the shaft 22 so it can be interchanged with other tips 28 to accommodate changes in ground surfaces.

The grip 24 could have a body 34 of a generally cylindrical shape with a top end 36 and a bottom end 38. The body 34 could be made of a resilient material such as cork, polymer, rubber or other suitable material and further feature finger or hand grooves 40 and a top and bottom collars, 42, 44 for fit accommodation of the operator's hand when grasping the grip 2. The grip 24 generally being constructed to be left-handed or right-handed. A suitable wrist loop 46 could be attached to the grip 24. The body 34 could have a top end 36 and a bottom end 38 wherein the top end 36 has a top aperture 48 connecting to a top open-ended channel 50 and a bottom end 52 has an bottom open-ended channel 54, the two channels 50, 54 substantially sharing a common longitudinal axis 56 with the grip 34. The bottom aperture 52 and bottom open-end channel 54 is shaped and sized to reciprocally accept and retain the first end 30 of the shaft 22. The top open-ended channel 50 may be shaped and sized to generally receive and retain the first end or cylinder portion 60 of the canister 26.

The hand-held, hand-operated, self-contained irritant spray canister 26 may be a self-defense spray canister, such as Pocket Pepper Mace® Spray 80332 made by the Mace Security International, 240 Gibraltar Rd, Suite 220 Horsham, Pa. 19044 USA. These canisters 26 are originally used separately and apart from walking sticks as self-defense irritant spray devices in their own right. Users may carry them in their pockets, purses, holsters; and grasp them in their hand to pull them out; aim the canister an attacking threat; and activate (e.g., press a trigger) the canister 26 to emit or release an irritant spray, stream, or foam at the threat.

These canisters 26 may have a first end portion comprise of pressurized hollow cylinder 62 (or a housing-cylinder combination) containing the pressurizing propellant (e.g., pressurized carbon dioxide gas, nitrogen gas, or the like) and a solution containing one or more different animal irritants (e.g., oleo capsicum; phenacyl chloride; 2-chlorobenzalmalononitrile; and the like, or combinations thereof, etc.) wherein one end of the cylinder 62 is connected to second end portion 64 of the canister containing activating and dispensing mechanisms 66, 68. The dispensing mechanism 68 may be a valve 72 (e.g., spring-biased to a closed position) connecting the interior of the cylinder 62 to a nozzle 70 that allows the contents of the cylinder 62 to be disbursed to the exterior environment. The activating mechanism 66 may be a housing 74 covering the valve 72 and on its top, a hingedly attached safety cover 76 that is spring-biased to generally reversibly cover a trigger 78. The trigger 78 may be connected to the valve 72 so that when the trigger 78 is being pressed down (after the safety cover 76 is moved away, e.g., in an up position), it may open the valve 72 to emit the irritant spray to the outside environment.

The first or cylinder portion 60 of the canister 26 can be inserted into the reciprocally-shaped and sized top opened-ended channel 50 of the grip 24 so that the second end portion 64 of the canister 26 containing activating and dispensing mechanisms 66, 68 is exposed and positioned above the top end 36 of the grip 24. The fit of the canister 26 to the top open-ended channel 50 may be constructed to allow the first end portion 60 may substantially be reversibly retained through friction fit. This could allow a used or spent canister 26 to be removed from the grip 24 and be replaced with a fresh one.

In another embodiment of the invention, a suitable adhesive could be applied between the canister 26 and the grip 24 to generally permanently hold the canister 26 in place in the grip 24. With such an embodiment, the invention 10, once the canister 26 had been used to emit the irritant spray, could be properly disposed and replaced with a new walking stick 20 with a fresh canister 26.

Figure 2:
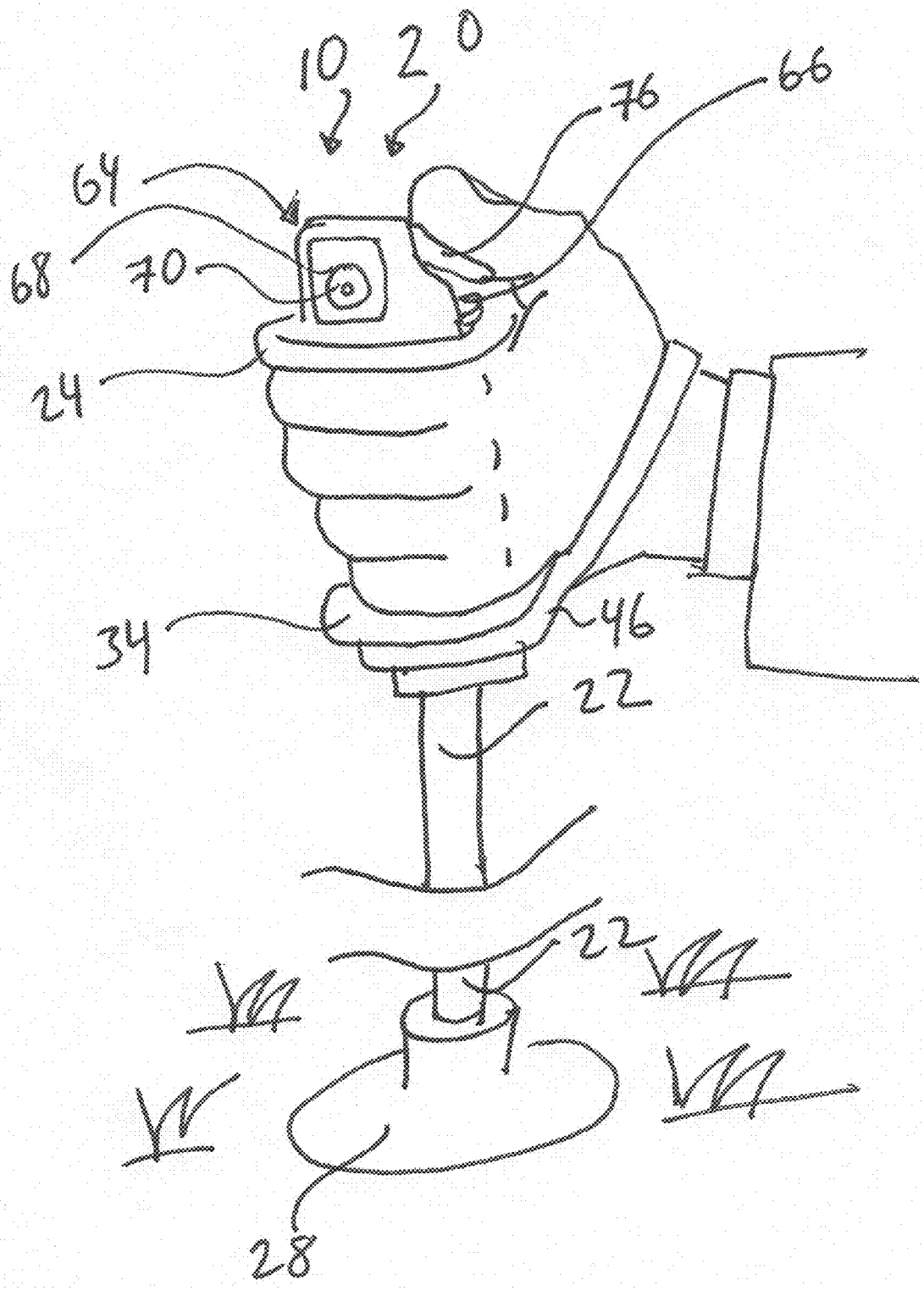
FIG. 2 is substantially a perspective view of one embodiment of the present invention with operator's thumb on safety cover.
Figure 3:
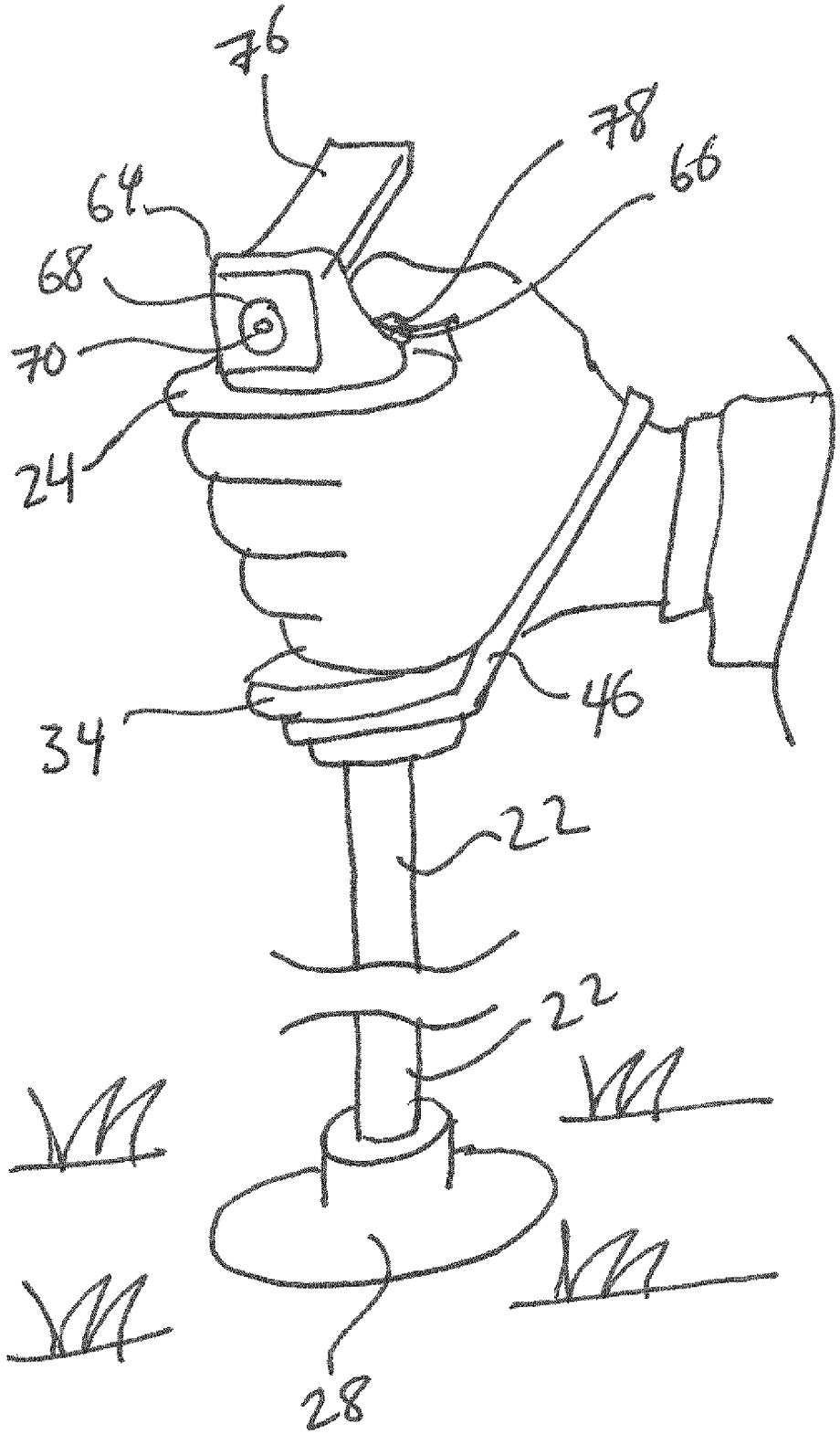
FIG. 3 is substantially a perspective view of one embodiment of the present invention with operator's thumb on trigger.

Generally, the construction of the walking stick has the nozzle 70 placed toward the front of the walking stick 20 and locates the grip 24, the top and bottom apertures 48, 52, the top and bottom open-ended channels 50, 54, the shaft 22, and canister 26 in a common longitudinal axis 56. The invention's construction also substantially allows the operator to grasp the walking stick by the grip 24 and walk with it while resting a respective thumb on portion containing activating and dispensing mechanisms (e.g., resting the thumb on the safety cover.) As substantially shown is FIGS. 2, 3, the operator can generally maintain the walking stick 20 in a vertical orientation, without shifting weight from the stick 20 and bring the stick 20 into firing position without a substantial change in the operator's position or hand position by keeping his thumb in contact with the second end portion 64.

Figure 4:
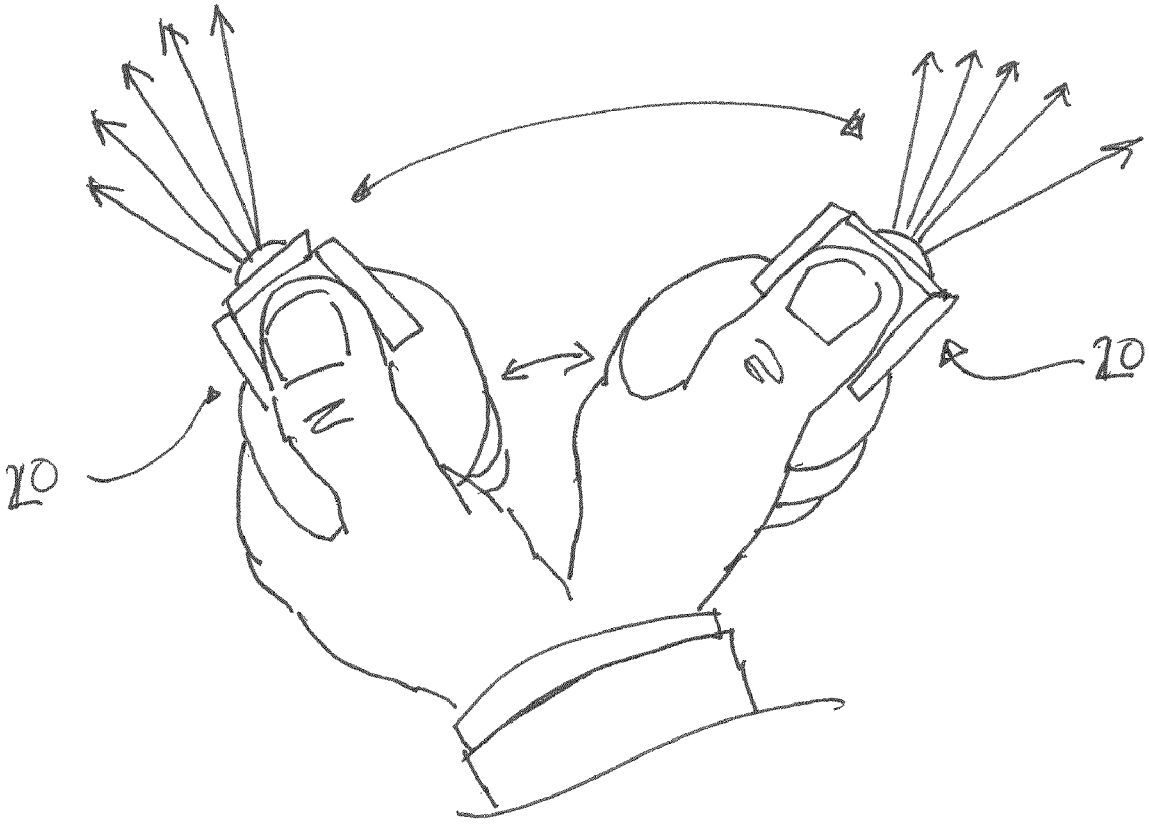
FIG. 4 showing pivoting action of the operator's hand to move the spray from left-to-right.
Figure 5:
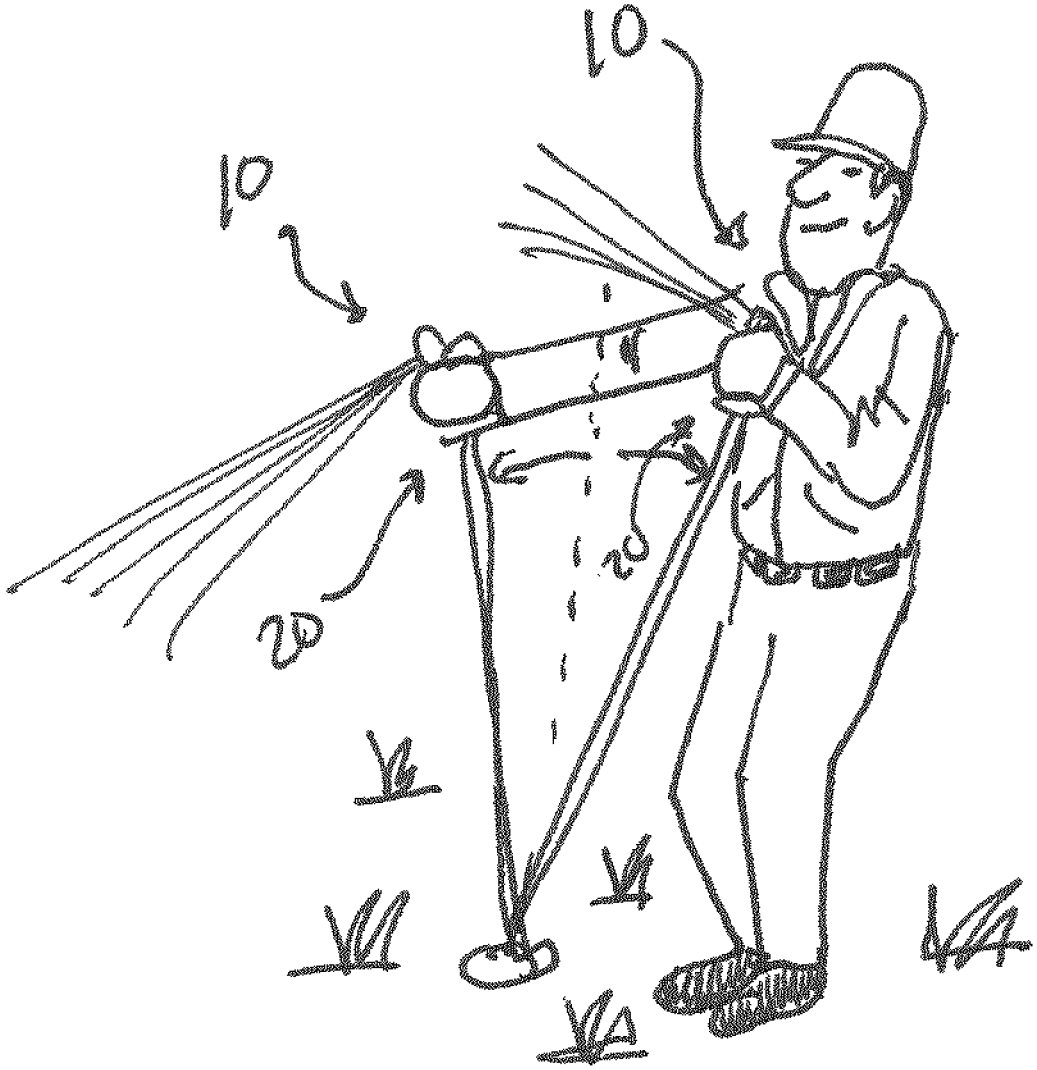
FIG. 5, showing extension-retraction of operator's arm to move the spray from up-to-down.

As substantially shown is FIGS. 4, 5, this firing position can be obtained by pivoting (e.g., side-to-side type motion) the grasping hand at the wrist to move the stick 20 through a generally 45° degree or more movement to direct the nozzle left-to-right/right-to-left range and by extending or retracting the grasping arm to move nozzle up or down. In this manner, the operator may effect the general aiming of the nozzle at the position of the perceived attacking threat. The tip 28 in this aiming sequence does not need to leave the ground but can be pivoted relative to the ground to aim the invention 10 at the threat to be deterred; likewise the grasping hand does not have to reposition itself relative to the grip 24 to aim or activate the canister 26; and the thumb can generally stay in contact with the containing activating and dispensing mechanisms 66, 68 while moving from a non-activating position (e.g., resting on top of safety cover) to an activating position (e.g., moving safety cover to up position and pressing down on the trigger.)

Figure 6:
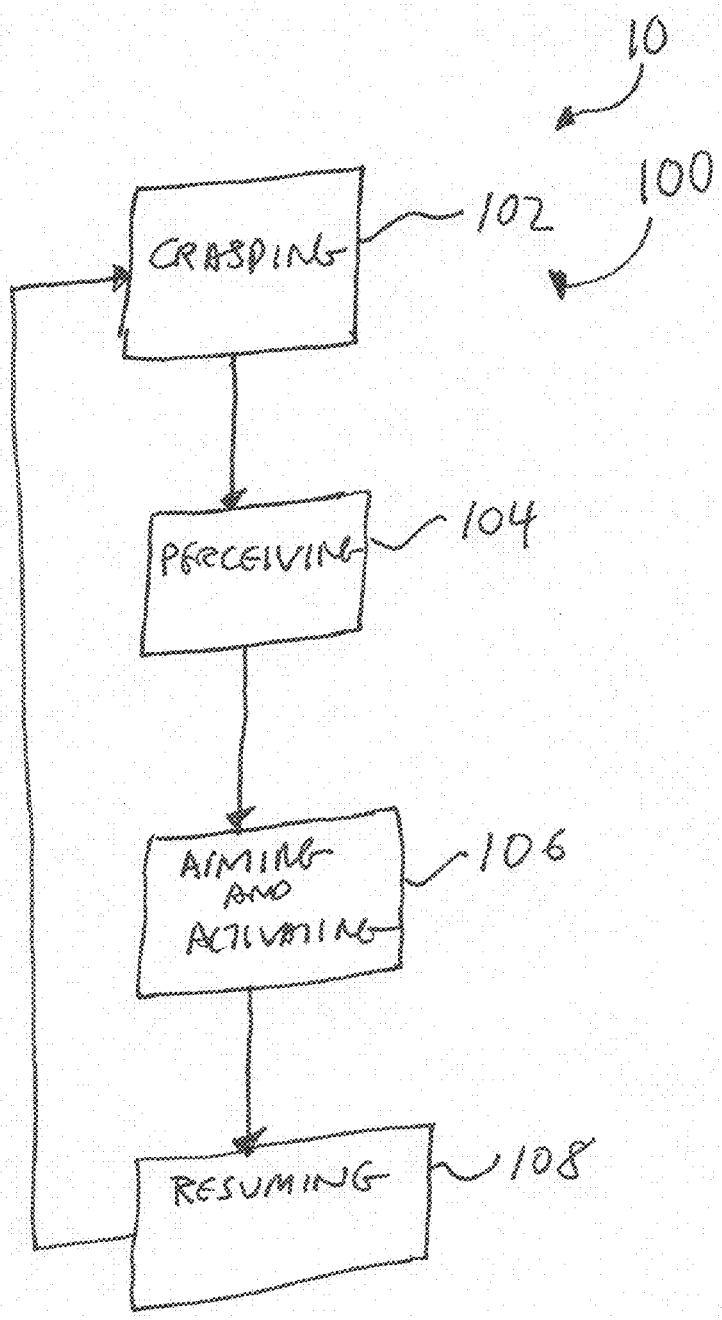
FIG. 6 is substantially a flowchart of one embodiment of the process of operating the present invention.

As substantially shown in FIG. 6, one possible methodology or process 100 of operating the invention 10 could begin with step 102, grasping the walking stick. In this step, the operator may use one or two walking sticks for walking. If telescopic, the shafts of the sticks could be adjusted to the desired adjustable length. If a pair of walking sticks is employed, one stick could use a canister deploying one type of irritant spray while the other stick uses another type of irritant spray. For example, one stick could have a canister utilizing one spray to be used on human threats (rather than non-human animal threats), while the other stick could have a canister whose spray is more effective on non-human animal threats than human threats.

The types of irritant spray utilized by the invention could include the type of projection (foam, stream, gas sprays) as well as type of composition (e.g., pepper spray, tear gas spray, etc.) If the embodiment is the one using a friction fit to hold the canister to the grip, the operator could select various canisters depending on threats to be expected. One possible example could be that one hiking stick has a canister to have a spray/composition types to be selected for one type of encounter (e.g., human threat) while the second hike stick has a canister to have a spray/composition types be selected for handing a non-human animal encounter (e.g., black bear.)

Once so adjusted, the operator could grasp with the appropriate hand the appropriate stick by the grip. If included, the hand could be placed through a loop attached to the grip. The thumb could be placed up and rest on top of the safety cover. As the operator begins to walk, he or she could move the walking sticks much in the fashion that ski poles in cross-country skiing are moved to help propel the operator and the like. When resting, the walking stick(s) could be held in front of the operator in generally a vertical position to help support weight that the operator could be carrying. When this step 102 is substantially completed, the process 100 can move to step, 104, perceiving threat.

In step 104, perceiving threat, the animal threat, human and otherwise, can be understood by the operator based a variety of conditions. In being in the wilds, the operator generally needs to be aware of and watch/listen to its surrounds, and not just concentrate on the pathway being covered. An example with bears, once seen, if the bear is making growling sounds, ears back, and clacking it teeth, it's a warning (to the "intruding" operator) to move back slowly out of proximity of the bear. If the bear on the other hand is not growling, not clacking it teeth, and is closely slowly and deliberately with the operator, with its ears forward, it is moving into attack position/stalking as found in predator feeding behavior. At this point, the operator in appraising that the immediate conditions to his welfare are dangerously deteriorating moves its thumb(s) from the top of the safety cover(s) to move the cover(s) away from the trigger(s) and rest the thumb(s) on the trigger(s). At the substantial completion of this step, the process may proceed to step 106, aiming and activation.

In this step 106, aiming and activating, the operator, can pivot the stick(s) on their tip(s) to aim the nozzle(s)/front of the stick(s) towards the recognized threat. This can be accomplished by side-to-side pivoting the operator's hand(s) at the wrists and/or extending/retracting the operator's arm(s) to point the nozzles in the direction of the threat. Once so aimed and the threat(s) still warranting defensive action, the operator could press the trigger(s) (both triggers simultaneously, or in a staggered fashion) to emit irritant spray(s) toward the threat/attacker. By watching the spray pattern(s) (direction of the foam, stream, etc) being emitting, the operator can track the interception of the irritant emission pattern with the moment of the threat to ensure contact of the irritant discharge/spray(s) with the threat(s). Once the threat has been reduced or nullified, the operator can disengage the threats, and deactivate the canister by relieving pressure on the trigger(s) to close the valve(s) and stop the irritant spray(s). After this step has been substantially completed, the process can proceed to step 108, resuming non-defensive activities.

In step 108, resuming non-defensive activities, the operator can with the non-disposable type of walking sticks, remove the spent canister(s) with fresh canisters, or change out a canister with one having more suitable irritant spray based on expected attacks based on the most recent encounter. The operator could further move out of the attack area, report the encounter to authorities, or take other appropriate action as warranted to complete the walk/hike in safety. At the end of the hike, the operator could return to step 102 when it commences a new hike.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As shown in the description above and the drawings the invention provides a self-defense spray walking stick that incorporates a hand-held, hand-operated, self-contained self-defense spray device in a manner that reduces the activation time and reduces the need for repositioning the stick and operator's grasping hand to aim and operate the stick against threats.

What is claimed is:

1. A self-defense walking stick comprising of:

(A) a shaft, the shaft having two ends, a first end and a second end;

(B) a grip, the grip having a body with a top end and a bottom end, the top end having a top aperture connected to a top open-ended channel, the bottom end having a bottom aperture connected to a bottom open-ended channel that receives the first end of the shaft;

(C) an aerosol irritant dispensing canister wherein a portion of the canister is retained within the top open-ended channel to expose a remaining portion above the top end, the canister being a hand-held, hand-operated, self-contained device having activating and dispensing mechanisms exposed and positioned above the top end of the grip, the activating mechanism including a hingedly movable safety cover that is hingedly connected to the retaining portion of the canister and at least partially and reversibly covers a trigger, the trigger being pressed to release an aerosol irritant spray through a nozzle of the dispensing mechanism with the cover being opened, and, the trigger, and the nozzle being located above the top end of the grip, the canister, the grip, and the shaft have a common longitudinal axis, wherein a thumb of an operator is able to be placed and maintained on and operate the activating and dispensing mechanisms while walking.

2. The self-defense walking stick of claim 1 wherein an adhesive holds the portion of the canister to the top open-ended channel.

3. The self-defense walking stick of claim 1 wherein a friction fit between the grip and the portion of the canister reversibly holds the portion of the canister within top open-ended channel.

4. The self-defense walking stick of claim 3 wherein the canister is a hand-held, hand-operated, self-contained device that is removed from the grip after its activation and is replaced with a fresh canister.

5. The self-defense walking stick of claim 1 wherein the canister is a hand-held, handoperated, self-contained device that can be operated separately from the stick.

6. The self-defense walking stick of claim 1 wherein an aerosol irritant spray is projected perpendicular from the common longitudinal axis.

7. The self-defense walking stick of claim 6 wherein the aerosol irritant spray is projected while the tip is in contact with the ground.

8. The self-defense walking stick of claim 1 wherein the activation mechanism supports the operator's thumb during activation of the canister and during walking.

9. A process of operating a walking stick comprising of the following steps, but not necessarily in the order shown:

(A) providing an walking stick having at least a shaft, a grip, and a hand-held, hand-operated, self-contained aerosol irritant dispensing canister, the grip being located on one end of the shaft, the canister having a pressurized cylinder containing at least one irritant, the cylinder connected to activating and dispensing mechanisms that are exposed and located above an end of the grip that is not connected to the shaft, and the grip, canister, and shaft sharing a common longitudinal axis the activating mechanism including a trigger being pressed to release the irritant through a nozzle of the dispensing mechanism located above the end of the grip, and a hingedly movable safety cover being connected to the cylinder and at least partially and reversibly covering the trigger;

(B) grasping the grip with a hand of an operator to place and maintain a thumb of the hand upon the activating mechanism and to allow the operator to walk with the stick;

(C) moving the hand without repositioning the hand on the grip to point the dispensing mechanism in the direction of a threat while maintaining the stick in a vertical orientation; and (D) operating the activation mechanism to move the thumb from top of the safety cover to underneath the safety cover to press a trigger to project an irritant spray towards the threat.

10. The process of claim 9 wherein moving the hand is a side-to-side pivoting movement that does not require the operator to shift weight off of the stick.

11. The process of claim 9 further comprises removing a one type of hand-held, hand-operated, self-contained aerosol irritant dispensing canister from the grip and replacing it with different type of canister on the basis of threat expecting to be encountered.

12. A self-defense walking stick comprising of:

(A) a shaft having two ends, a first end and a second end;

(B) a grip having a body with a top end and a bottom end, the top end having a top opened-ended channel, the bottom end having a bottom open-ended channel that receives the first end of the shaft;

(C) a hand-held, hand-operated, self-contained aerosol irritant dispensing canister, the canister having a pressurized cylinder containing at least one irritant, the cylinder connected to activating and dispensing mechanisms, a portion of the canister being removably retained within the top open-ended channel to leave the activating and dispensing mechanisms being exposed above the top end of the grip, the activating mechanism including a trigger being pressed to release the irritant through a nozzle of the dispensing mechanism, and a hingedly movable safety cover connected to the cylinder and at least partially and reversibly covering the trigger; wherein the shaft, the grip, and the canister have a common longitudinal axis.

13. The self-defense walking stick of claim 12 wherein the activating mechanism is so constructed that the operator in grasping the grip with its hand places and maintains a thumb upon the activation mechanism as the operator uses the stick for both walking and discharging the irritant.

14. The self-defense walking stick of claim 12 wherein the irritant is a solution containing a compound from a list of compounds consisting of oleo capsicum; phenacyl chloride; 2-chlorobenzalmalononitrile.

* * * * *